US011596960B2

(12) United States Patent
Sweeton

(10) Patent No.: US 11,596,960 B2
(45) **Date of Patent: *Mar. 7, 2023**

(54) SUSTAINED DURATION TRIGGER SPRAYERS AND METHODS FOR MAKING THE SAME

(71) Applicant: Silgan Dispensing Systems Corporation, Richmond, VA (US)

(72) Inventor: Steven Sweeton, Lake Winnebago, MO (US)

(73) Assignee: Silgan Dispensing Systems Corporation, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/332,081

(22) Filed: May 27, 2021

(65) Prior Publication Data

US 2021/0283632 A1 Sep. 16, 2021

Related U.S. Application Data

(63) Continuation of application No. 16/309,133, filed as application No. PCT/US2017/038438 on Jun. 21, 2017, now Pat. No. 11,027,301.

(60) Provisional application No. 62/352,636, filed on Jun. 21, 2016.

(51) Int. Cl.
*B05B 11/00* (2006.01)

(52) U.S. Cl.
CPC ..... *B05B 11/3011* (2013.01); *B05B 11/3016* (2013.01); *B05B 11/3069* (2013.01); *B05B 11/3077* (2013.01)

(58) Field of Classification Search
CPC ..... B05B 11/3011; B05B 11/3016; B05B 11/3069; B05B 11/3077; B05B 1/3405; B05B 11/0056
See application file for complete search history.

(56) References Cited

U.S. PATENT DOCUMENTS 5,228,602 A * 7/1993 Maas ..... B05B 11/3011 222/340
5,561,901 A 10/1996 Stahley et al.
5,823,395 A * 10/1998 Foster ..... B05B 11/3011 222/384
6,641,003 B1 * 11/2003 Foster ..... B05B 11/007 222/383.1

(Continued)

FOREIGN PATENT DOCUMENTS

CN 105620892 A * 6/2016

*Primary Examiner* — Bob Zadeh
(74) *Attorney, Agent, or Firm* — Barlow, Josephs & Holmes, Ltd.; Stephen J. Holmes

(57) ABSTRACT

A sustained duration trigger sprayer capable of dispensing at least 3 mL of product over a time period of about 3 seconds utilizing a force-to-actuate of between about 10 pounds and about 15 pounds. The trigger sprayer includes an enlarged piston bore and piston and an elongated trigger lever creating a high output fluid displacement with a 0.5 inch displacement distance. The container bottle and/or the sprayer shroud are contoured to provide a gripping area opposing the terminal end of the trigger lever wherein the gripping distance in from the gripping area to the terminal end of the trigger lever is no greater than 3.3 inches.

19 Claims, 7 Drawing Sheets

(56) References Cited

U.S. PATENT DOCUMENTS

| | | | | |
|---|---|---|---|---|
| 7,497,358 | B2 * | 3/2009 | Clynes | B05B 11/3011 222/340 |
| 7,942,291 | B2 * | 5/2011 | Foster | B05B 11/3074 222/384 |
| 8,714,415 | B2 * | 5/2014 | Rech | B05B 11/0059 222/376 |
| 2004/0118877 | A1 | 6/2004 | von Schuckmann et al. | |
| 2006/0086762 | A1 * | 4/2006 | Foster | B05B 7/0025 222/383.1 |
| 2006/0086763 | A1 * | 4/2006 | Foster | B05B 11/0044 222/383.1 |
| 2006/0237485 | A1 | 10/2006 | An | |
| 2009/0308897 | A1 * | 12/2009 | Foster | B05B 11/3045 222/383.1 |
| 2012/0211528 | A1 | 8/2012 | Greeley | |
| 2014/0319244 | A1 * | 10/2014 | Rech | B05B 11/304 239/337 |

* cited by examiner

SUSTAINED DURATION TRIGGER SPRAYERS AND METHODS FOR MAKING THE SAME

CROSS-REFERENCE TO RELATED APPLICATIONS

This application is a continuation of U.S. application Ser. No. 16/309,133, filed Dec. 12, 2018, which is a Section 371 National Stage filing of PCT Patent Application No. PCT/US2017/038438, filed Jun. 21, 2017, which claims the benefit of U.S. Provisional Patent Application No. 62/352,636, filed Jun. 21, 2016, the entire contents of which are incorporated herein by reference.

BACKGROUND OF THE DISCLOSURE

Field of the Invention: The invention relates to trigger sprayers and more particularly to trigger sprayer constructions and configurations to provide a sustained duration spray or a spray lasting longer than traditional trigger sprayers.

State of the Art: Trigger sprayers are well known and are commonly used as delivery devices to deliver a product, such as a liquid, from a container to a surface or an area in which the product is desired. For example, trigger sprayers may be used to apply cleaning agents to hard surfaces or to deliver air freshener to a volume of air or area of fabric. The use and applications for such devices are well known.

Typically, the actuation of a trigger sprayer will dispense about 1.5 cc of fluid or less. In many examples, conventional trigger sprayers deliver 1.0 cc or less of fluid per stroke of the trigger sprayer lever. While such distribution of product—1.0 cc or a slight bit more per stroke—is typically sufficient for users, there are times in which additional product is required or desired. For instance, in some cases there may be a large surface area that needs to be cleaned, requiring multiple "strokes" or actuations of the trigger sprayer to dispense sufficient product to cover the given area. Similarly, when using trigger sprayers with air freshener, a user may be required to stroke the trigger sprayer multiple times to obtain a desired application or dispersion of product from a container to which the trigger sprayer is connected.

Although a user may actuate a trigger sprayer multiple times to obtain a desired output, there is a need for trigger sprayers having a larger output per stroke. Furthermore, there is a desire to have a better user experience with trigger sprayers for traditional and nontraditional applications.

BRIEF SUMMARY OF THE INVENTION

According to certain embodiments of the invention, a trigger sprayer includes an extended trigger lever, a larger diameter piston bore and piston, and a force-to-actuate between about 10 pounds and about 15 pounds such that actuation of the trigger lever may be carried out for a sustained duration and may dispense from about 3 ml of product up to about 5 mL of product. In some embodiments, the sustained duration may last about three seconds at a force-of-actuation between about 10 and about 15 pounds with a total dispense of about 5 mL. In some embodiments the grip distance between a rear of the trigger sprayer shroud and the forward end of the trigger lever may about 3.3 inches and the displacement distance is about 0.5 inches.

BRIEF DESCRIPTION OF THE DRAWINGS

While the specification concludes with the claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

A trigger sprayer according to various embodiments of the invention may include a valve body, an input valve, an output valve, a discharge orifice, a trigger lever, and a piston attached to the trigger lever. A spring may be in communication with the trigger lever, the piston, or both to encourage return of the trigger lever to a non-actuated position upon a release or reduction of force on the trigger lever.

A valve body may include a piston bore into which the piston is positioned, however, according to various embodiments of the invention, the diameter of the piston bore and piston is larger than a traditional trigger sprayer. The increased diameter of the piston bore and piston fitted into the piston bore, allows the trigger sprayer to maintain an acceptable force-to-actuate between about 10 and about 15 pounds. In addition, the piston bore and piston may be configured such that a fluid chamber defined by the piston bore walls and the piston has a volume large enough to provide between about 3 cc (0.10 ounces) to about 5 cc (0.15 ounces) of fluid to be dispensed per stroke of the trigger lever.

A trigger lever according to embodiments of the invention is generally longer than a conventional trigger lever and is configured to provide a grip distance of about 3.3 inches (8.382 cm) from a forward end of the trigger lever to a rear side of the shroud or container opposite the trigger lever. The grip distance is configured along with the volume of a fluid chamber in the piston bore to allow a stroke length of about 0.5 inches (1.27 cm) with a force-to-actuate between about 10 and about 15 pounds.

Figure 1:
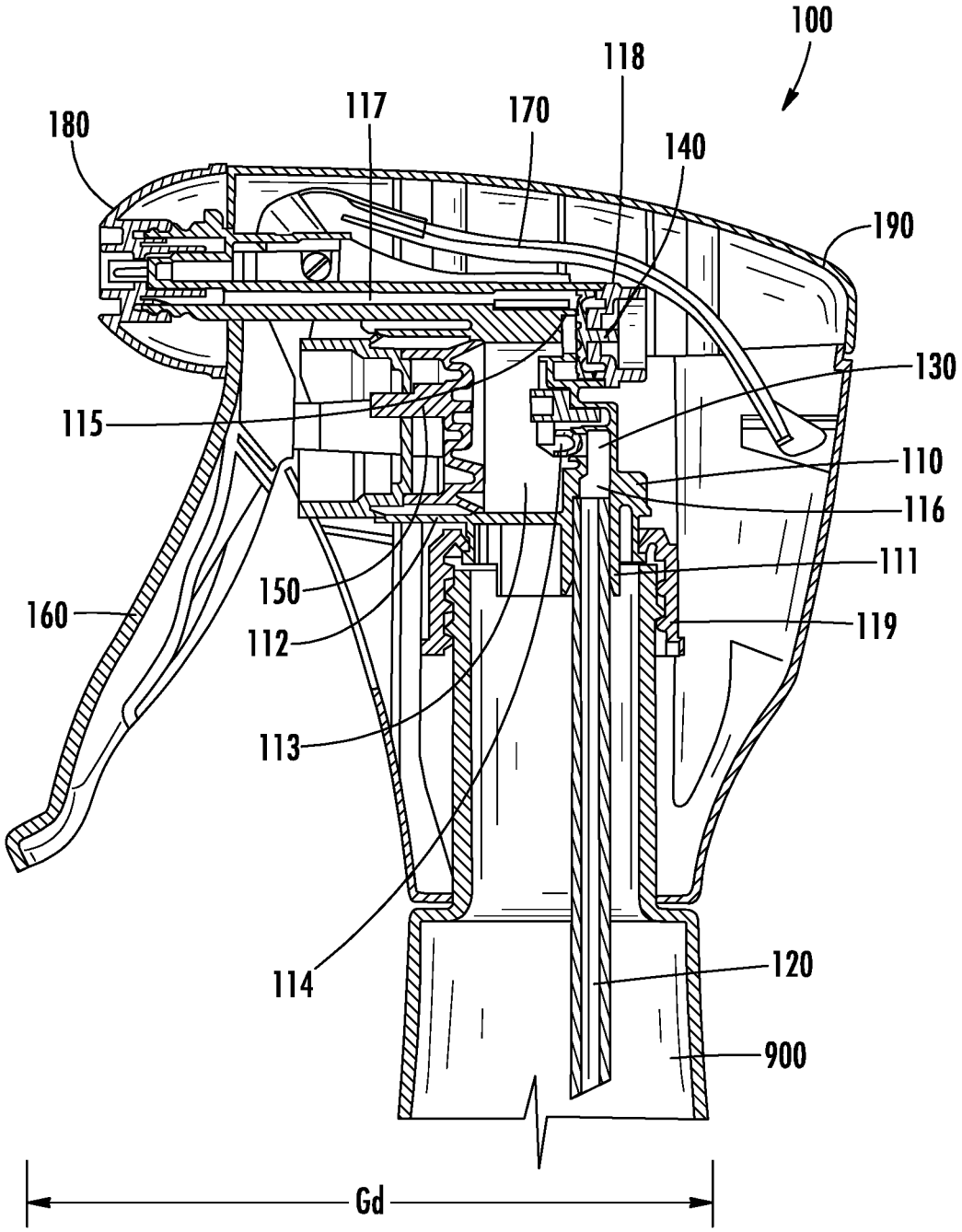
FIG. 1 illustrates a cross-sectional view of an exemplary embodiment of the trigger sprayer according to the invention.
Figure 2:
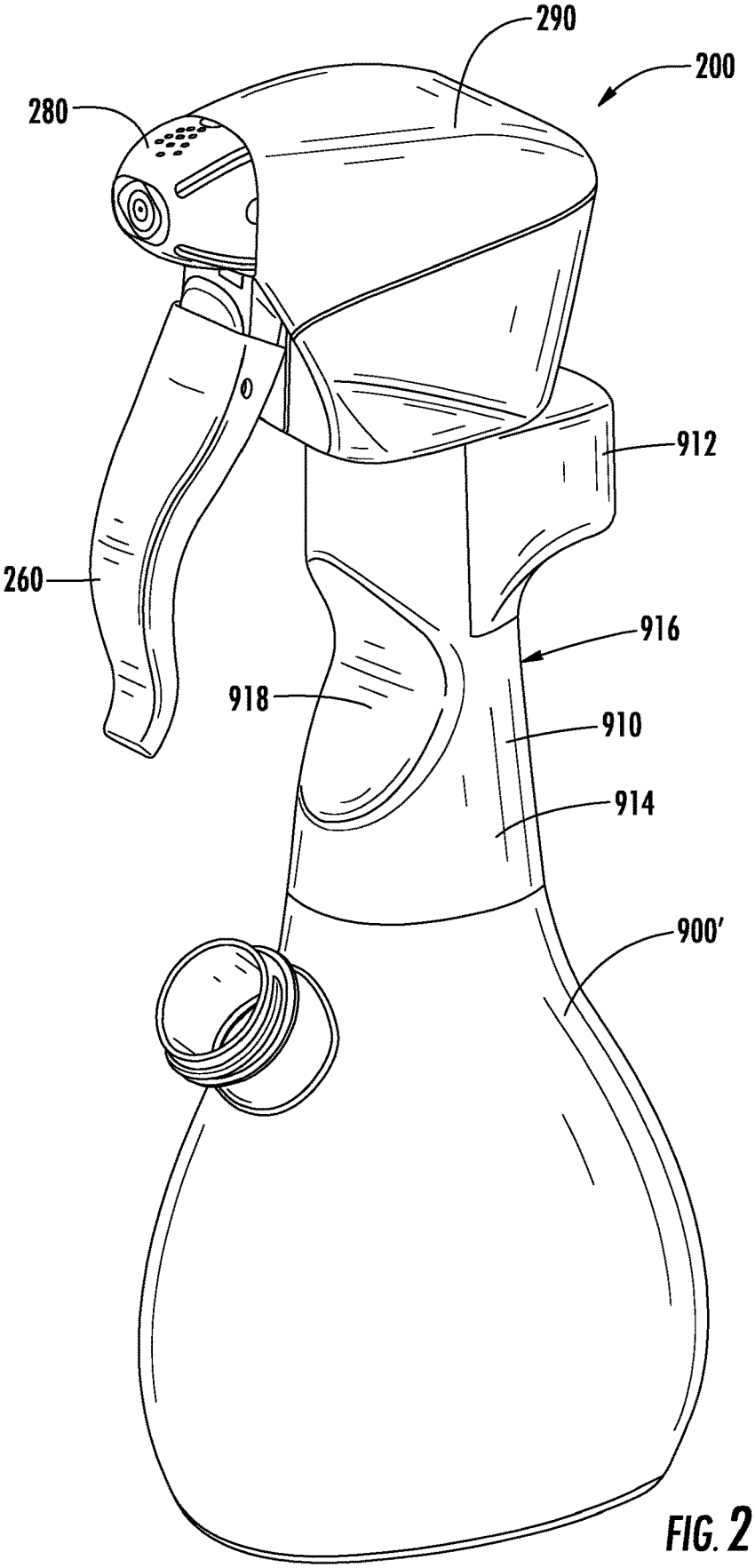
FIG. 2 illustrates a perspective view of an exemplary embodiment of a trigger sprayer assembly including a contoured neck.
Figure 3:
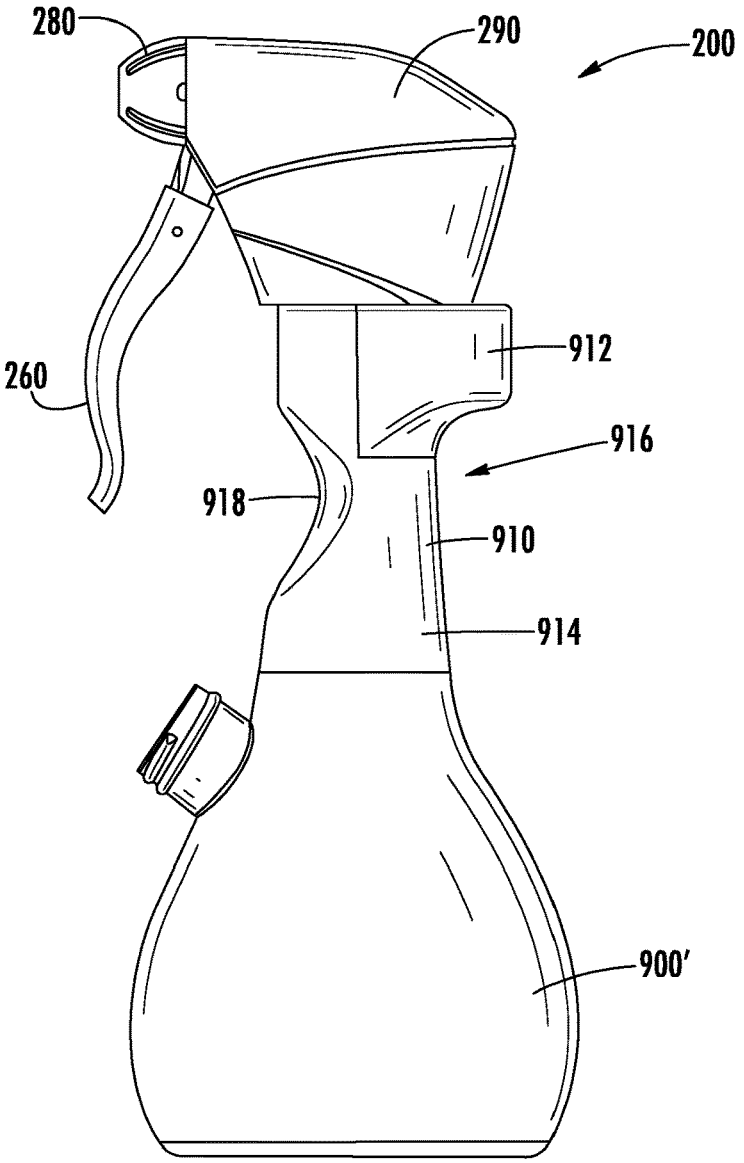
FIG. 3 is a front view thereof.
Figure 4:
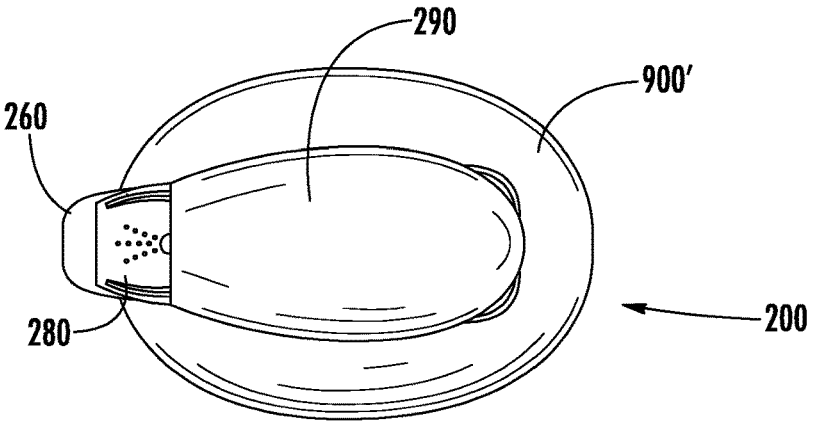
FIG. 4 is a top view thereof.
Figure 5:
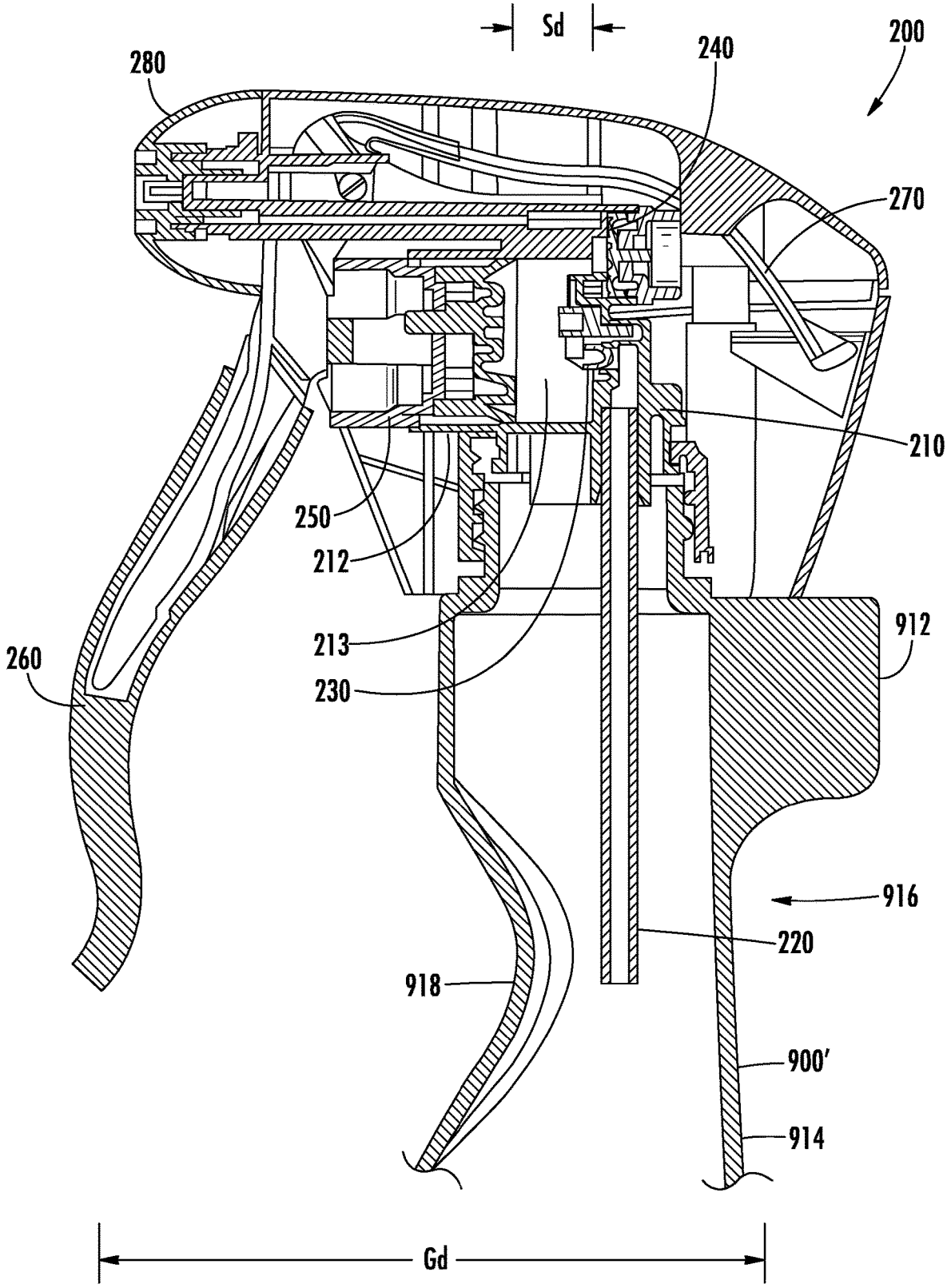
FIG. 5 is a cross-sectional view thereof taken along line 5-5 of FIG. 4.
Figure 6:
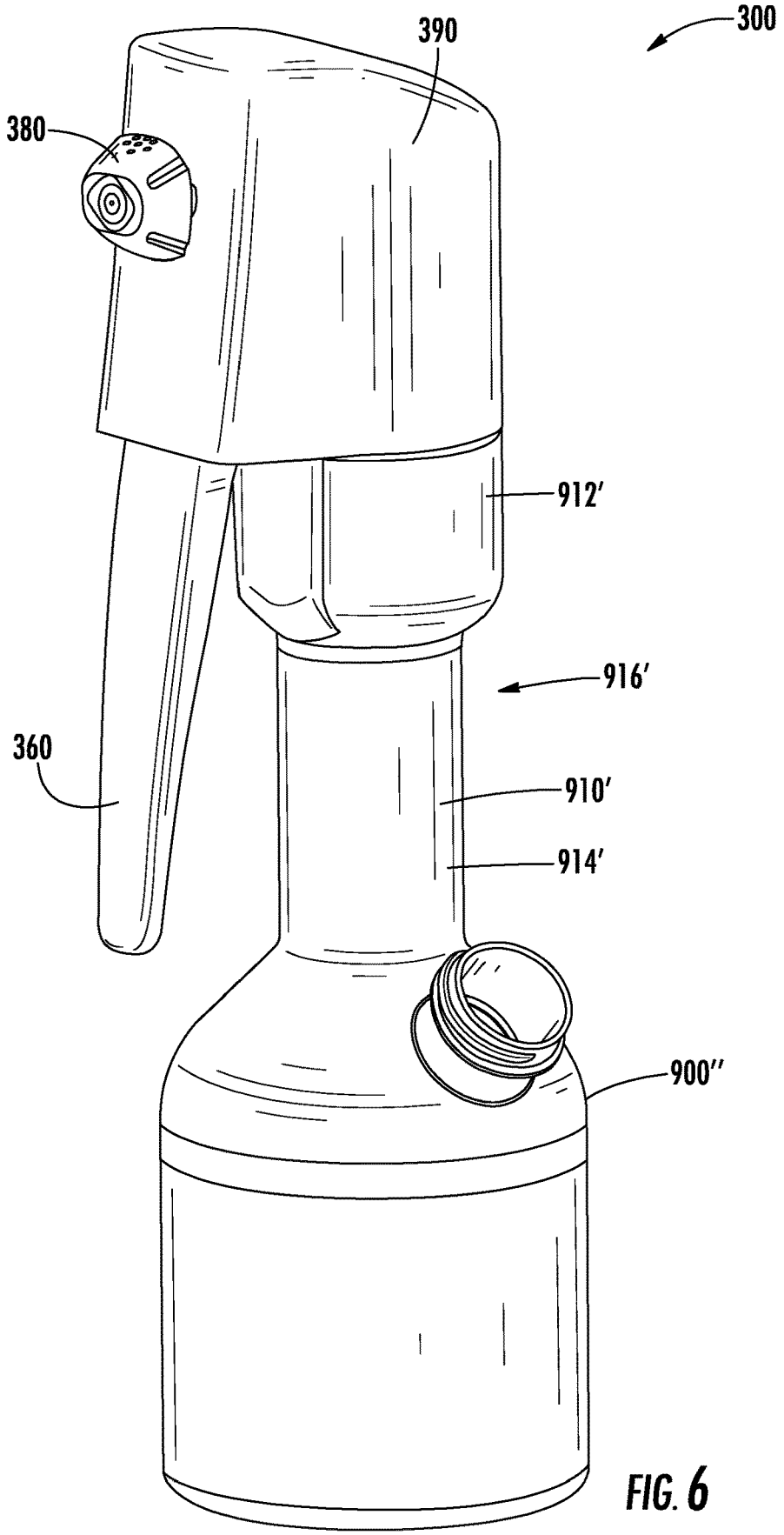
FIG. 6 illustrates a perspective view of yet another exemplary embodiment of a trigger sprayer assembly.
Figure 7:
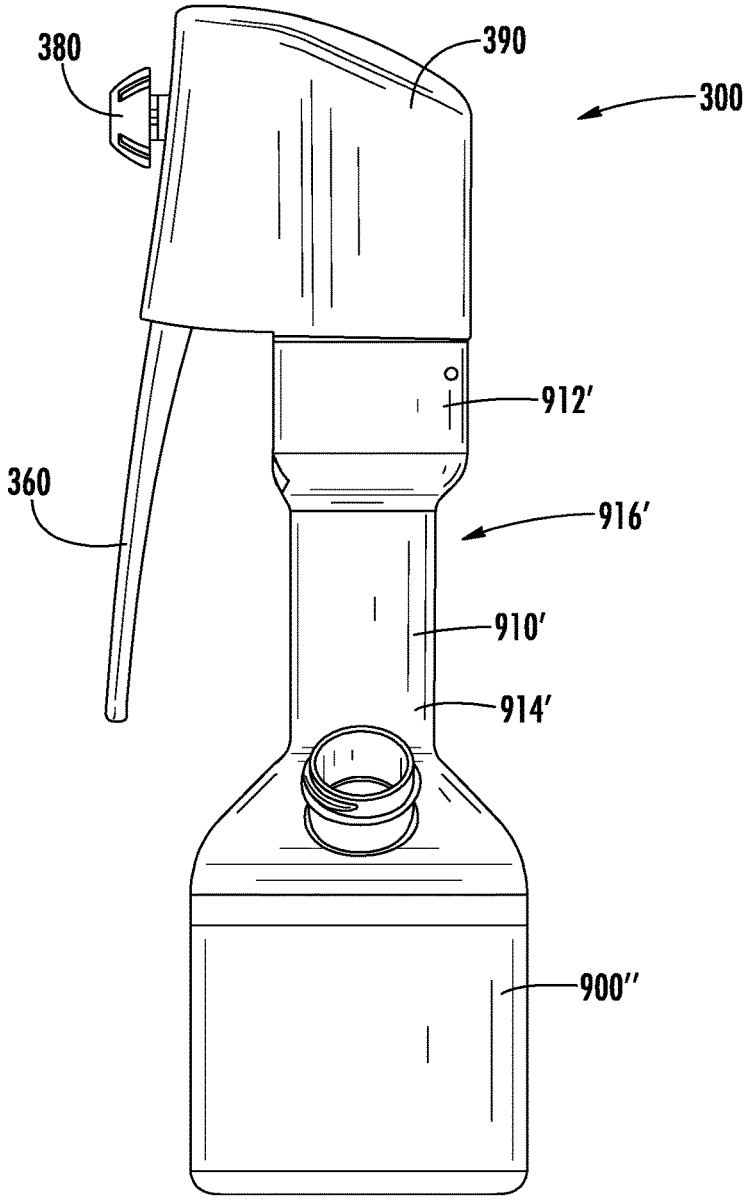
FIG. 7 is a front view thereof.
Figure 8:
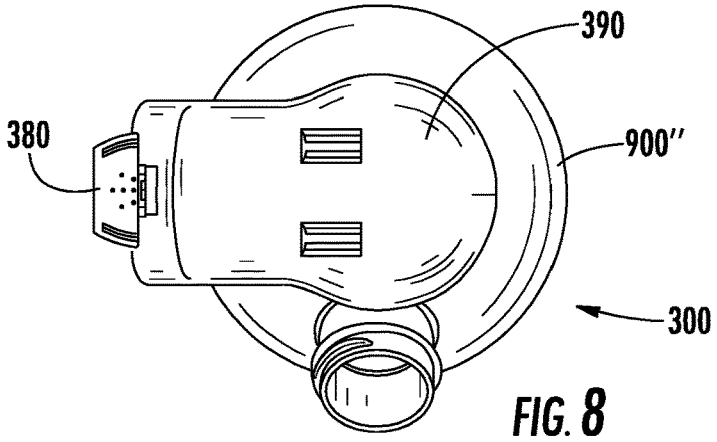
FIG. 8 is a top view thereof.
Figure 9:
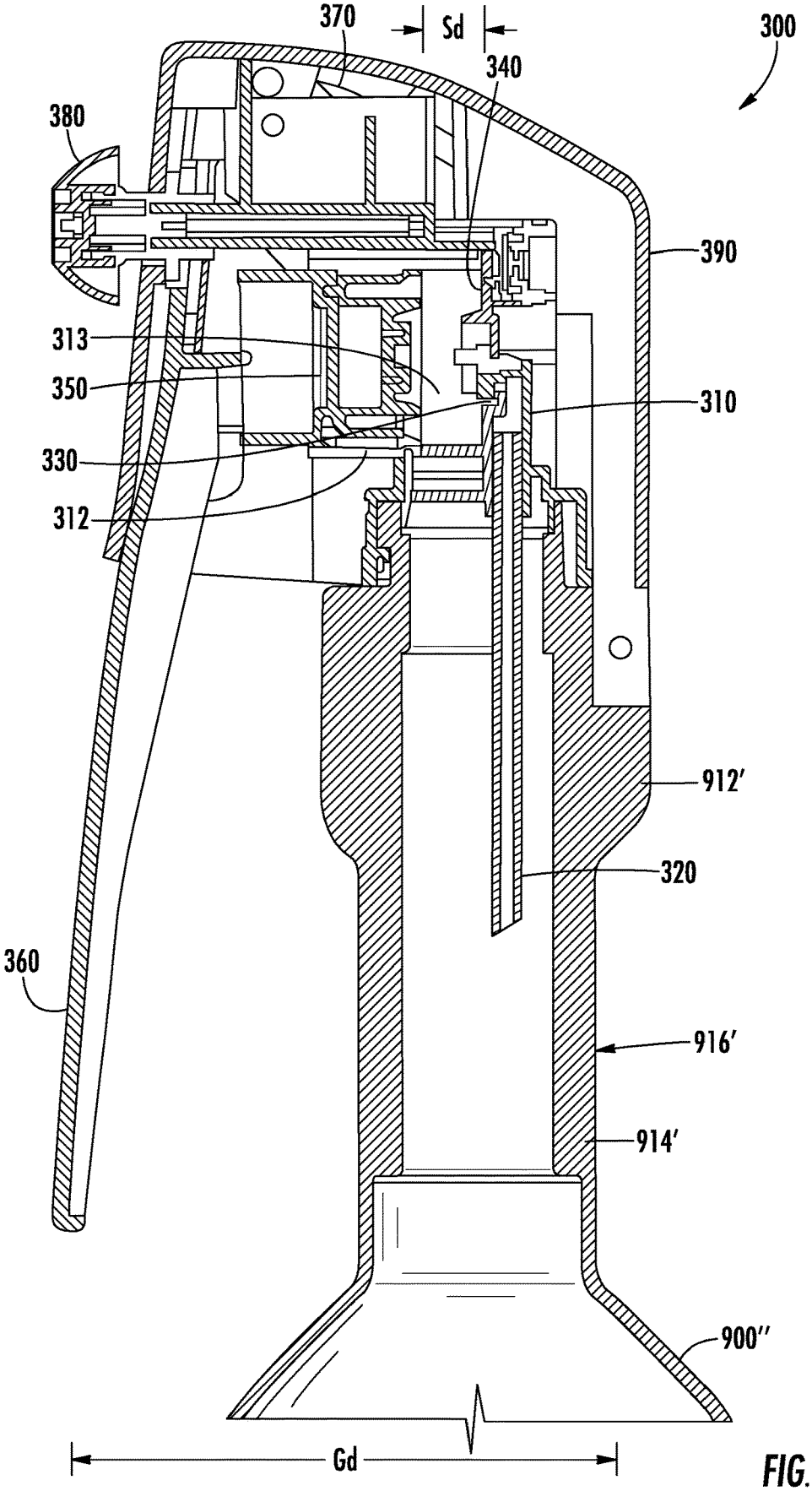
FIG. 9 is a cross-sectional view thereof taken along line 9-9 of FIG. 8.

A trigger sprayer 100 attached to a container 900 according to certain embodiments of the invention is illustrated in FIG. 1. As illustrated, a trigger sprayer 100 may include a valve body 110, a dip tube 120, an inlet valve 130, an outlet valve 140, a piston 150, a trigger lever 160, a spring 170, a nozzle 180 and a shroud 190.

According to certain embodiments of the invention, a valve body 110 may include a dip tube retainer 111 into which a dip tube 120 may be inserted or retained. The valve body 110 also includes a piston bore 112 into which the piston 150 sits or is mounted. A fluid chamber 113 is formed between a surface of the piston 150 and the interior walls of the piston bore 112. An inlet opening 114 and an outlet opening 115 may be located in a wall of the valve body 110 defining the piston bore 112. The valve body 110 may also include an inlet fluid path 116 and a discharge fluid path 117. The inlet fluid path 116 may be located between the dip tube retainer 111 and the inlet opening 114 and it may be in fluid communication with the fluid chamber 113 through the inlet valve 130. The discharge fluid path 117 may be located between the outlet opening 115 and the nozzle 180 which is attached to the valve body 110. In some embodiments of the invention, an outlet valve seat 118 may be formed in the valve body 110 adjacent to, or as part of, the outlet opening 115. A valve body 110 may also include a container connector 119 configured to connect the trigger sprayer 100 to a container 900. A container connector 119 may include a bayonet-style connector, a threaded connector as illustrated in FIG. 1, or other conventional connector or connection system used to connect trigger sprayers to containers.

A dip tube 120 may be seated or otherwise retained in the dip tube retainer 111 portion of the valve body 110. In other embodiments, a dip tube retainer may be connected to the valve body and a dip tube 120 to put the dip tube 120 in fluid communication with the valve body 110 and a product in the container 900. In still other embodiments, a container 900 may include a blown in dip tube and the valve body 110 dip tube retainer 111 may extend into the container 900 to connect with the blown-in dip tube of the container 900, in which case a further dip tube 120 would not be required.

An inlet valve 130 may include any conventional inlet valve as desired. As illustrated in FIG. 1, an inlet valve 130 may include a post capable of being inserted into an inlet valve post opening in the valve body 110 such that the inlet valve 130 is retained on an interior portion of the fluid chamber 113 with a portion covering and sealing against the inlet opening 114. In this manner, an inlet valve 130 is formed that selectively allows fluid to flow from a container 900 into the fluid chamber 113 upon the return stroke or when the piston 150 is moving away from the rear wall of the piston bore 112 where the inlet opening 114 is positioned.

An outlet valve 140 may also be selected from any conventional outlet valves. In some embodiments, an outlet valve 140 may be of the pre-compression type, such that the outlet valve 140 only opens once a certain cracking pressure has been reached within the fluid chamber 113 or against the outlet valve 140. An outlet valve 140 may seat against the outlet opening 115 in some embodiments of the invention or against an outlet valve seat 118 in other embodiments of the invention. For example, an outlet valve 140 may be of the type disclosed in U.S. Application Publication 2012/0261438, which is incorporated herein by reference in its entirety. Use of a pre-compression type outlet valve may provide a user with a cleaner start and finish to the spray of the trigger sprayer 100.

A piston 150 is inserted into the piston bore 112 of the valve body 110. The piston 150 and the piston bore 112 have a diameter which is larger than the diameter of a conventional trigger sprayer. In addition, the wall of the piston 150 facing the rear wall of the piston bore 112 may be configured to match the contours of the rear of the piston bore 112 as well as any contour formed by the inlet valve 130 or other components therein. In some embodiments of the invention, the fluid chamber 113 formed between the piston 150 and the interior walls of the piston bore 112 is capable of holding—or has a volume that is greater than—3 cc or 3 mL of fluid (0.10 ounces).

A trigger lever 160 may be mounted to the valve body 110 or otherwise configured to act as a lever. The trigger lever 160 may be connected to the piston 150 such that movement of the trigger lever 160 moves the piston 150 within the piston bore 112. According to certain embodiments of the invention, the trigger lever 160 is longer than a conventional trigger lever on a trigger sprayer. The forward-most end of the trigger lever 160 may be configured for a user to grip the trigger lever 160 at that point. According to certain embodiments of the invention, when a user has a hold of the trigger sprayer 100 and places their finger or fingers on the trigger lever 160 adjacent the most-forward end of the trigger lever 160, the grip distance "Gd" is about 3.3 inches (8.382 cm) or less.

According to certain embodiments of the invention, the positioning of the trigger lever 160 and the volume of the fluid chamber 113 is such that displacement of the trigger lever 160 by 0.5 inches (1.27 cm) is sufficient to empty or push the contents of the fluid chamber 113 past the outlet valve 140, through the discharge fluid path 117 and out the nozzle 180. According to embodiments of the invention, the force-to-actuate the trigger lever 160 in such a configuration is about 10 to about 15 pounds.

A spring 170 may be connected to the trigger lever 160, the piston 150, or both to create a return force against the trigger lever 160 following actuation of the trigger sprayer 100. In some embodiments of the invention, a spring 170 may be integrated with the trigger lever 160 as illustrated in FIG. 1. In such embodiments, the integrated spring 170 may act against the shroud 190 to provide the necessary spring force to return the trigger lever 160 to a non-actuated position. In other embodiments of the invention, a spring 170 may include a metal coil, a plastic spring, or other configuration. Conventional spring 170 shapes and sizes may be used with various embodiments of the invention.

A nozzle 180 may be attached to the valve body 110 adjacent the end of the discharge fluid path 117. According to embodiments of the invention, a nozzle 180 may include any desired spray mechanics to create the swirl and pressure mechanics required to create a spray pattern for the fluid or product contained in the container 900.

A shroud 190 may be attached to a valve body 110 to provide an aesthetic appeal to the trigger sprayer 100 or to help retain components of the trigger sprayer 100 and assist in their function. In some embodiments of the invention, a shroud 190 may be a single structure configured to attached to or snap-on to the valve body 110. In other embodiments, a shroud 190 may be made of two or more portions as illustrated in FIG. 1. A shroud 190 according to embodiments of the invention may be shaped to provide an ergonomic grip for a user. In some embodiments, the shroud 190 is shaped to force a user's hand to a lower portion of the shroud 190 in order to provide the best possible grip on the trigger lever 160 for actuating the trigger sprayer 100. In some embodiments, the shroud 190 has enlarged dimensions at an upper end thereof, and reduced dimensions at a lower end thereof and is contoured to create a gripping area on the lower end thereof opposing the terminal forward end of the trigger lever 160.

Referring now to FIGS. 2-5, a trigger sprayer 200 is attached to a container 900' having an elongated neck 910. As illustrated, the sprayer 200 may include a valve body 210 with a piston bore 212, a dip tube 220, an inlet valve 230, an outlet valve 240, a piston 250, a trigger lever 260, a spring 270, a nozzle 280 and a shroud 290. Generally, the interior working components of the sprayer 200 may be the same as illustrated and described hereinabove and the piston bore 212 and piston 250 are sized approximately for a 3 cc product dispense volume in the fluid chamber 213, a 0.5 inch displacement stroke (dS), a 3.3 inch or less grip distance (Gd) and a 10-15 pound force to actuate.

The neck portion 910 of the container 900' receives the trigger sprayer 200, wherein the neck portion 910 has enlarged dimensions at an upper end 912 thereof, and reduced dimensions at a lower end 914 thereof and the upper and lower ends 912,914 of the neck are contoured to create a gripping area 916 adjacent the lower end thereof opposing the terminal forward end of the trigger lever 260. Further, the neck portion 910 is inwardly contoured on the front side facing the elongated trigger lever to provide a mating relief area 918 for the terminal forward end of the trigger lever 260 when actuated.

Referring now to FIGS. 6-9, a trigger sprayer 300 is attached to a container 900" having an elongated neck 910'. As illustrated, the sprayer 300 may include a valve body 310 with a piston bore 312, a dip tube 320, an inlet valve 330, an outlet valve 340, a piston 350, a trigger lever 360, a spring 370, a nozzle 380 and a shroud 390. Generally, the interior working components of the sprayer 300 may be the same as illustrated and described hereinabove. In this exemplary embodiment, the piston bore 312 and piston 350 are sized approximately for a larger 5 cc product dispense volume in the fluid chamber 313, a 0.5 inch displacement stroke, a 3.3 inch or less grip distance (Gd) and a 10-15 pound force to actuate.

The neck portion 910' of the container 900" receives the trigger sprayer 200, wherein the neck portion 910' has enlarged dimensions at an upper end 912' thereof, and reduced dimensions at a lower end 914' thereof and the upper and lower ends 912',914' of the neck are contoured to create a gripping area 916' adjacent the lower end thereof opposing the terminal forward end of the trigger lever 360. As illustrated the reduced dimensions of lower end of the neck portion 910' provide a relief area for the terminal forward end of the trigger lever 260 when actuated to permit the trigger lever a full actuation distance.

According to various embodiments of the invention, a trigger sprayer 100/200/300 such as that illustrated in FIG. 1-9 may provide a sustained duration spray of approximately three seconds based on typical user interactions with a trigger sprayer. By configuring the volume of the fluid chamber 113/213/313 to hold from about 3 mL (0.10 ounces) of fluid to about 5 mL (0.15 ounces) of fluid and limiting the displacement Sd of the piston 150/250/350 to about 0.5 inches (1.27 cm) through the stroke of the trigger lever, and with a force-to-actuate the trigger lever between about 10 and about 15 pounds, a typical user will be able to dispense the contents of the fluid chamber over a three second actuation pulling at a force of about 10 pounds to about 15 pounds. In addition, the ergonomic design of the shroud and/or its interaction with the container and container neck provides a comfortable grip for the user to allow continued actuation of the trigger lever over the approximate three second period.

While various embodiments of the invention are described herein, it is understood that the particular embodiments defined by the appended claims are not to be limited by particular details set forth in the description, as many apparent variations thereof are contemplated. Rather, embodiments of the invention are limited only by the appended claims, which include within their scope all equivalent devices or methods which operate according to the principles of the embodiments of the invention described.

What is claimed is:

1. A trigger sprayer, comprising:
a valve body;
a piston bore defined by the valve body, the piston bore comprising:
an interior wall; and
a rear wall;
a piston seated in the piston bore, comprising a piston wall facing the rear wall of the piston bore;
a fluid chamber defined by the piston wall, the interior wall of the piston bore, and the rear wall of the piston bore, wherein the fluid chamber comprises a volume of at least 3 cc;
an inlet valve in a lower portion of the rear wall of the piston bore;
an outlet valve in an upper portion of the rear wall of the piston bore;
a trigger lever mounted to the valve body and the piston, the trigger lever comprising a forward end;
a shroud attached to the valve body, the shroud comprising a rear side opposite the trigger lever;
a grip distance defined by the distance between the forward end of the trigger lever and the rear side of the shroud; and
wherein a force-to-actuate the trigger lever is between 10 pounds and 15 pounds.

2. The trigger sprayer of claim 1, wherein the fluid chamber volume further comprises a volume of between 3 mL and 5 mL.

3. The trigger sprayer of claim 1, wherein the fluid chamber volume further comprises less than 5 mL.

4. The trigger sprayer of claim 1, wherein the grip distance further comprises 3.3 inches.

5. The trigger sprayer of claim 1, wherein the grip distance further comprises a grip distance of 3.3 inches or less.

6. The trigger sprayer of claim 1, wherein the grip distance further comprises a distance allowing a stroke length of the trigger lever of 0.5 inches.

7. The trigger sprayer of claim 1, further comprising fluid in the fluid chamber and wherein displacement of the trigger lever by 0.5 inches dispenses at least 3 mL of the fluid from the trigger sprayer.

8. The trigger sprayer of claim 1, further comprising fluid in the fluid chamber and wherein displacement of the trigger lever by 0.5 inches dispenses between 3 mL and 5 mL of the fluid from the trigger sprayer.

9. A dispensing system, comprising:
a container; and
a trigger sprayer attached to the container, the trigger sprayer comprising:
a valve body;
a piston bore defined by the valve body, the piston bore comprising:
an interior wall; and
a rear wall;
a piston seated in the piston bore, comprising a piston wall facing the rear wall of the piston bore;
a fluid chamber defined by the piston wall, the interior wall of the piston bore, and the rear wall of the piston bore, wherein the fluid chamber comprises a volume of at least 3 cc;
an inlet valve in a lower portion of the rear wall of the piston bore;
an outlet valve in an upper portion of the rear wall of the piston bore;

a trigger lever mounted to the valve body and the piston, the trigger lever comprising a forward end;

a shroud attached to the valve body, the shroud comprising a rear side opposite the trigger lever;

a grip distance defined by the distance between the forward end of the trigger lever and the rear side of the shroud; and wherein a force-to-actuate the trigger lever is between 10 pounds and 15 pounds.

10. The dispensing system of claim 9, wherein the container further comprises a neck portion.

11. The dispensing system of claim 10, wherein the neck portion includes a threaded connector.

12. The dispensing system of claim 10, wherein the neck portion includes a bayonet-style connector.

13. The dispensing system of claim 9, further comprising a fluid product in the container.

14. The trigger sprayer of claim 9, wherein the fluid chamber volume further comprises a volume of between 3 mL and 5 mL.

15. The trigger sprayer of claim 9, wherein the fluid chamber volume further comprises less than 5 mL.

16. The trigger sprayer of claim 9, wherein the grip distance further comprises 3.3 inches.

17. The trigger sprayer of claim 9, wherein the grip distance further comprises a distance allowing a stroke length of the trigger lever of 0.5 inches.

18. The trigger sprayer of claim 9, further comprising fluid in the fluid chamber and wherein displacement of the trigger lever by 0.5 inches dispenses at least 3 mL of the fluid from the trigger sprayer.

19. The trigger sprayer of claim 9, further comprising fluid in the fluid chamber and wherein displacement of the trigger lever by 0.5 inches dispenses between 3 mL and 5 mL of the fluid from the trigger sprayer.

* * * * *